US006868905B2

(12) United States Patent
Lauritzen et al.

(10) Patent No.: US 6,868,905 B2
(45) **Date of Patent: *Mar. 22, 2005**

(54) EXPANDABLE SAND SCREEN FOR USE IN A WELLBORE

(75) Inventors: J. Eric Lauritzen, Kingwood, TX (US); Robert J. Coon, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/447,979

(22) Filed: May 29, 2003

(65) Prior Publication Data

US 2003/0196796 A1 Oct. 23, 2003

Related U.S. Application Data

(63) Continuation of application No. 09/885,850, filed on Jun. 20, 2001, now Pat. No. 6,571,871.

(51) Int. Cl.[7] ..... E21B 43/00
(52) U.S. Cl. ..... 166/227; 166/207
(58) Field of Search ..... 166/227–236, 166/207, 384, 56

(56) References Cited

U.S. PATENT DOCUMENTS

| | | | | |
|---|---|---|---|---|
| 1,963,629 A | | 6/1934 | Mark | 29/163.5 |
| 3,482,629 A | * | 12/1969 | Suman, Jr. | 166/255.1 |
| 5,901,789 A | | 5/1999 | Donnelly et al. | 166/381 |
| 6,263,972 B1 | | 7/2001 | Richard et al. | 166/381 |
| 6,315,040 B1 | | 11/2001 | Donnelly | 166/207 |
| 6,412,565 B1 | | 7/2002 | Castano-Mears | 166/381 |
| 6,571,871 B2 | | 6/2003 | Lauritzen et al. | 166/227 |
| 6,702,018 B2 | * | 3/2004 | McGregor et al. | 166/278 |
| 6,749,023 B2 | * | 6/2004 | Nguyen et al. | 166/278 |
| 2002/0020524 A1 | | 2/2002 | Gano | 166/55 |
| 2002/0046840 A1 | | 4/2002 | Schetky et al. | 166/277 |

FOREIGN PATENT DOCUMENTS

| | | | |
|---|---|---|---|
| GB | 2 336 383 A | 10/1999 | E21B/43/08 |
| WO | WO 01/29368 A1 | 4/2001 | E21B/34/14 |

OTHER PUBLICATIONS

Chapter 7, "Packing the Perforation Tunnels," pp. 40–44, undated.
Chapter 8, "Gravel–Pack Placement," pp. 45–57, undated.

* cited by examiner

*Primary Examiner*—Kenn Thompson
(74) *Attorney, Agent, or Firm*—Moser, Patterson & Sheridan, L.L.P.

(57) ABSTRACT

The present invention provides apparatus and methods for expanding an expandable sand screen in the wellbore and then fracturing the wellbore. In one aspect of the invention, an expandable sand screen includes a perforated inner pipe and outer shroud. The outer shroud includes a plurality of longitudinal channels that retain their general shape after the expandable sand screen is expanded. In the expanded state, the channels provide a fluid conduit along an area between the screen and the wall of the wellbore. In a subsequent fracturing operation, slurry travels along the conduits permitting communication of the fracturing slurry with hydrocarbon bearing formations.

28 Claims, 6 Drawing Sheets

EXPANDABLE SAND SCREEN FOR USE IN A WELLBORE

CROSS-REFERENCE TO RELATED APPLICATIONS

This application is a continuation of U.S. patent application Ser. No. 09/885,850, filed Jun. 20, 2001, now U.S. Pat. No. 6,571,871, which is herein incorporated by reference.

BACKGROUND OF THE INVENTION

1. Field of the Invention

The present invention relates to an expandable sand screen. More particularly the present invention relates to an expandable sand screen that permits fracturing of a hydrocarbon bearing formation after the well screen is expanded in a wellbore.

2. Description of Related Art

Hydrocarbon wells are typically formed with a central wellbore that is supported by steel casing. The casing lines the borehole in the earth and the annular area created between the casing and the borehole is filled with cement to further support and form the wellbore.

While some wells are produced by simply perforating the casing of the central wellbore and collecting the hydrocarbons, wells routinely include portions of wellbore that are left open or unlined with casing. Because they are left open, hydrocarbons in an adjacent formation migrate into these wellbores where they are affected along a perforated tubular or sand screen having apertures in its wall and some kind of filtering material to prevent sand and other particles from entering. The sand screen is attached to production tubing at an upper end and the hydrocarbons travel to the surface of the well via the tubing. In this specification "open" and "horizontal" wellbore refers to an unlined bore hole or wellbore.

Because open wellbores have no support provided along their walls, and because the formations accessed by these wellbores have a tendency to produce sand and particulate matter in quantities that hamper production along a sand screen, open wellbores are often treated by fracturing and packing. Fracturing a wellbore or formation means subjecting the walls of the wellbore and the formation to high pressure solids and/or fluids that are intended to penetrate the formation and stimulate its production by increasing and enlarging the fluid paths towards the wellbore. Packing a wellbore refers to a slurry of sand that is injected into an annular area between the sand screen and the walls of the wellbore to support the wellbore and provide additional filtering to the hydrocarbons. Fracturing and packing can be performed simultaneously. A cross-over tool is typically utilized to direct the fracturing/packing material towards the annulus of the open wellbore while returning fluid is circulated up the interior of the screen and returns to the surface of the well in an annular area of the central wellbore.

There are problems associated with the packing of an open wellbore. One such problem relates to sand bridges or obstructions which form in the annulus between the sand screen and the wall of the wellbore. These sand bridges can form anywhere along the wellbore and they prevent the flow of injected material as it travels along the annulus. The result is an incomplete fracturing/packing job that leaves some portion of the sand screen exposed to particulate matter and in some cases, high velocity particles that can damage the screen.

Today there exists a sand screen that can be expanded in the wellbore. This expandable sand screen "ESS" consists of a perforated base pipe, woven filtering material and a protective, perforated outer shroud. Both the base pipe and the outer shroud are expandable and the woven filter is typically arranged over the base pipe in sheets that partially cover one another and slide across one another as the ESS is expanded. The foregoing arrangement of expandable sand screen is known in the art and is described in U.S. Pat. No. 5,901,789 which is incorporated by reference herein in its entirety. Expandable sand screen is expanded by a cone-shaped object urged along its inner bore or by an expander tool having radially outward extending rollers that are fluid powered from a tubular string. Using expander means like these, the ESS is subjected to outwardly radial forces that urge the walls of the ESS past their elastic limit, thereby increasing the inner and outer diameter of the ESS.

The biggest advantage to the use of expandable sand screen in an open wellbore like the one described herein is that once expanded, the annular area between the screen and the wellbore is mostly eliminated and with it the need for a gravel pack. Typically, the ESS is expanded to a point where its outer wall places a stress on the wall of the wellbore, thereby providing support to the walls of the wellbore to prevent dislocation of particles.

While the ESS removes the need for packing the wellbore with sand, it does not eliminate the need to fracture the formation in order to improve production. Fracturing prior to expanding the screen in the wellbore is not realistic because the particulate matter, like the sand used in the fracturing will remain in the annulus and hamper uniform expansion of the screen. Fracturing after expansion of the expandable sand screen is not possible because, as explained herein, the annular path for the fracturing material has been eliminated.

There is a need therefore for an expandable sand screen for use in a wellbore to be fractured. There is a further need for an expandable sand screen that can be expanded prior to the fracturing of the wellbore surrounding the screen. There is yet a further need for an expandable sand screen that forms a path or conduit for the flow of fracturing material along its outer surface after it has been expanded.

SUMMARY OF THE INVENTION

The present invention provides apparatus and methods for expanding an expandable sand screen in an open wellbore and then fracturing the wellbore. In one aspect of the invention, an expandable sand screen includes a perforated inner pipe and outer shroud. The outer shroud includes a plurality of longitudinal channels that retain their general shape after the expandable sand screen is expanded. In the expanded state, the channels provide a fluid conduit along an area between the screen and the wall of the wellbore. In a subsequent fracturing operation, a slurry travels along the conduits permitting communication of the slurry with hydrocarbon bearing formations to effectively fracture the formation. In another aspect, a method of fracturing includes expanding an expandable well screen in a wellbore whereby the expanded screen provides longitudinal channels in communication with the hydrocarbon bearing formation. Thereafter, fracturing slurry is injected and travels along the channels, thereby exposing the slurry to the formation. In yet another aspect of the invention, joints of the ESS are assembled together into sections and the channels on the outer surface of each joint are aligned to ensure that the longitudinal channels are aligned throughout the ESS section.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
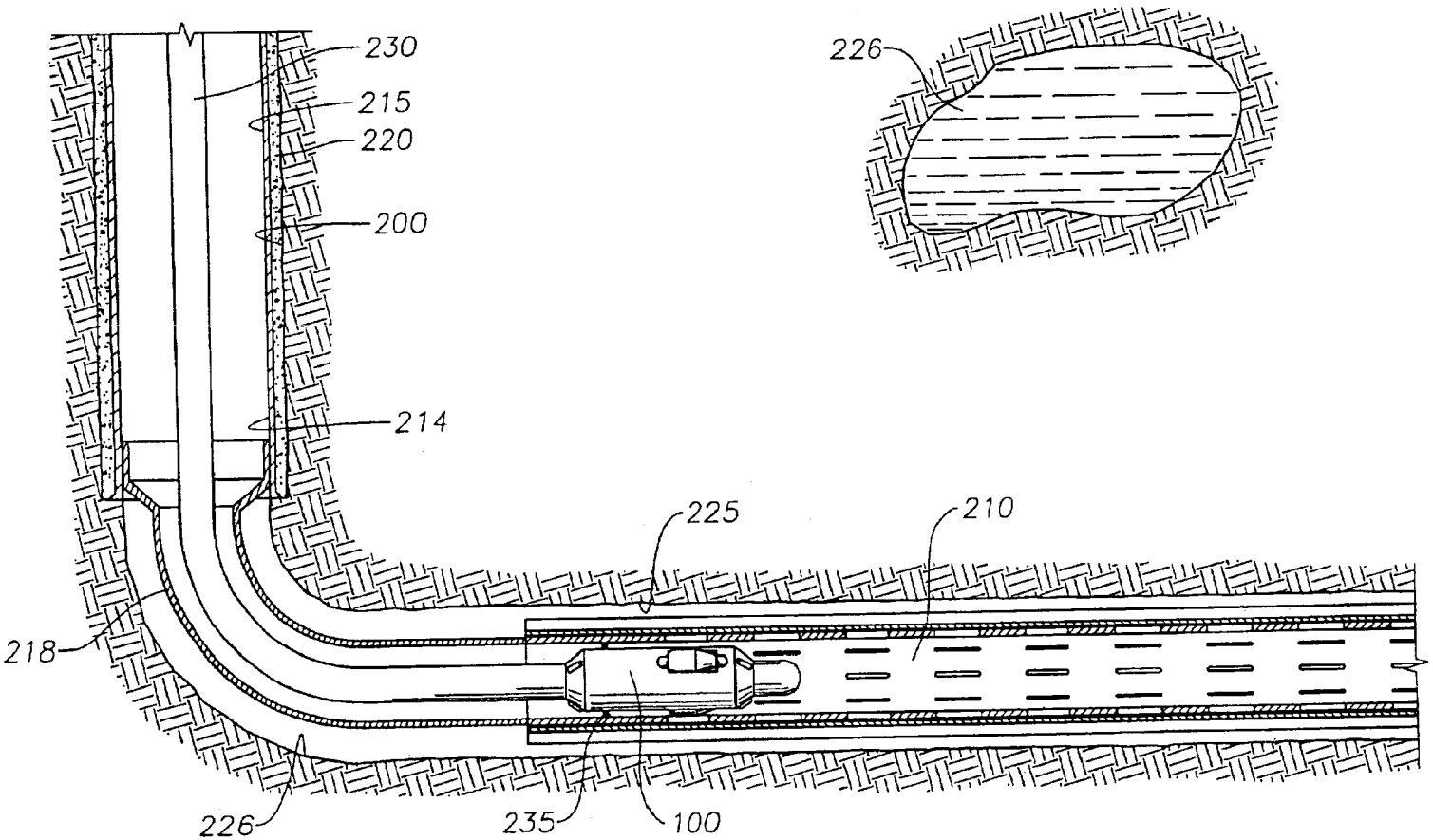
FIG. 1 is a section view showing an open, horizontal wellbore with an expandable sand screen disposed therein.

FIG. 1 is a section view of a wellbore 200 with an expandable sand screen 210 according to the present invention disposed therein. The wellbore includes a central wellbore which is lined with casing 215. The annular area between the casing and the earth is filled with cement 220 as is typical in well completion. Extending from the central wellbore is an open, horizontal wellbore 225. A formation 226 is shown adjacent the wellbore 225. Disposed in the open wellbore is an expandable sand screen (ESS) 210. As illustrated in FIG. 1, the ESS 210 is run into the wellbore on a tubular run-in string 230. Disposed at the end of the run-in string is an expander tool 100. In the embodiment shown, the expander tool 100 is initially fixed to the expandable sand screen 210 with a temporary connection 235 like a shearable connection or some other temporary mechanical means. Typically, the ESS 210 is located at the lower end of a liner 218 which is run into the well and hung from the lower portion of the casing 215 by some conventional slip means. Below the liner top, the outer diameter of the liner 218 is reduced to a diameter essentially equal to the diameter of the ESS.

Figure 2:
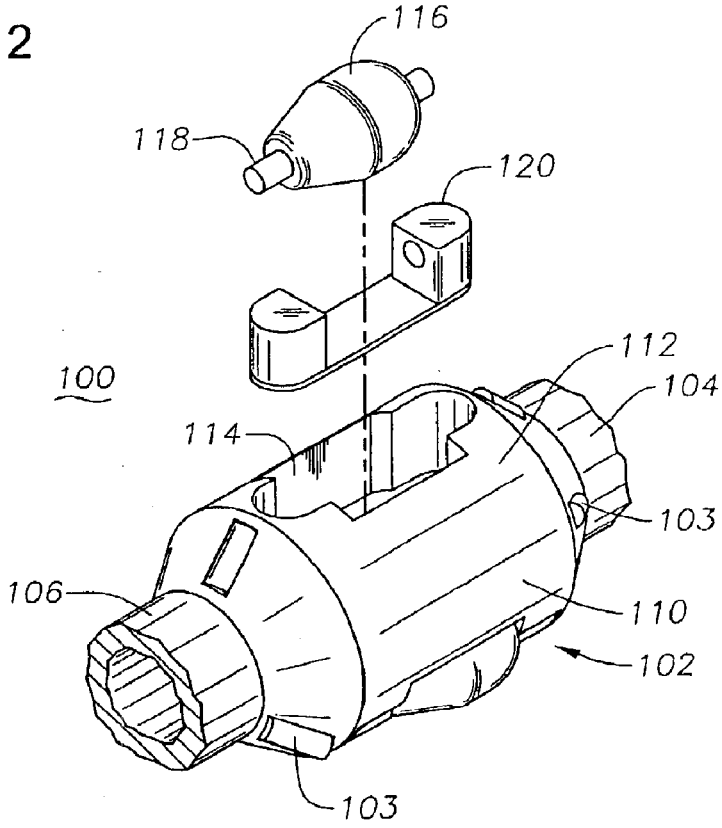
FIG. 2 is an exploded view of an expander tool.

FIG. 2 is an exploded view of an exemplary expansion tool 100. The expansion tool 100 has a body 102 which is hollow and generally tubular with connectors 104 and 106 for connection to other components (not shown) of a downhole assembly. The connectors 104 and 106 are of a reduced diameter compared to the outside diameter of the longitudinally central body part of the tool 100. The central body part has three recesses 114 to hold a respective roller 116. Each of the recesses 114 has parallel sides and extends radially from a radially perforated tubular core (not shown) of the tool 100. Each of the mutually identical rollers 116 is somewhat cylindrical and barreled. Each of the rollers 116 is mounted by means of an axle 118 at each end of the respective roller and the axles are mounted in slidable pistons 120. The rollers are arranged for rotation about a respective rotational axis which is parallel to the longitudinal axis of the tool 100 and radially offset therefrom at 120-degree mutual circumferential separations around the central body. The axles 118 are formed as integral end members of the rollers and the pistons 120 are radially slidable, one piston 120 being slidably sealed within each radially extended recess 114. The inner end of each piston 120 is exposed to the pressure of fluid within the hollow core of the tool 100 by way of the radial perforations in the tubular core. In this manner, pressurized fluid provided from the surface of the well, via a tubular, can actuate the pistons 120 and cause them to extend outward whereby the rollers contact the inner wall of a tubular to be expanded.

Figure 3:
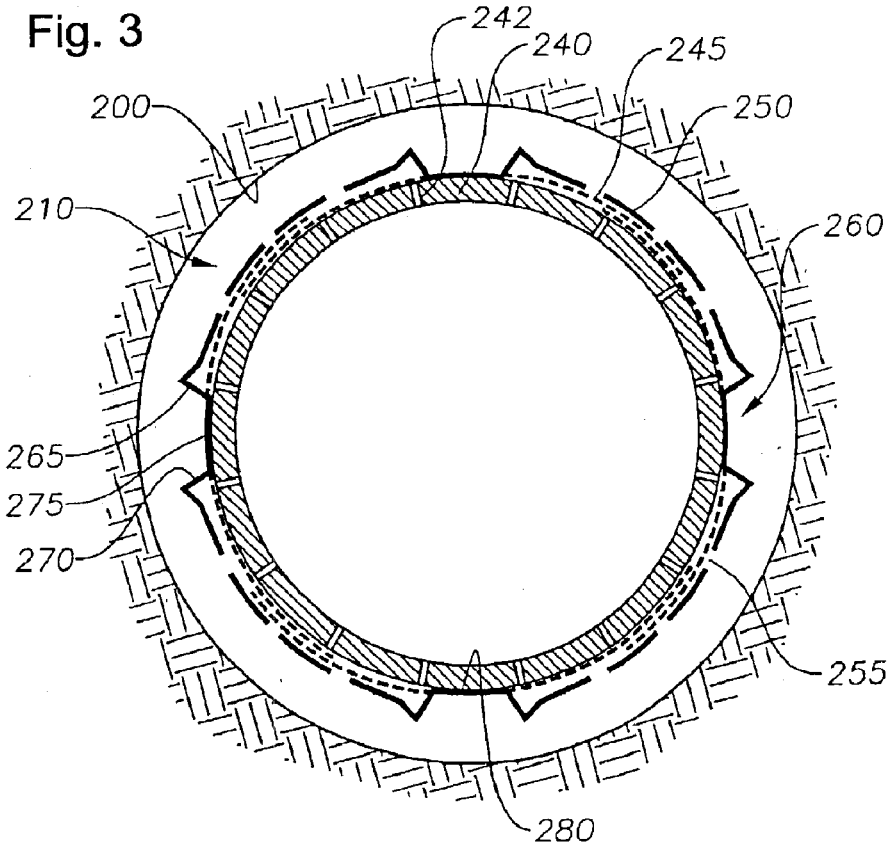
FIG. 3 is a section view of the expandable sand screen in an unexpanded state.

FIG. 3 is a section view of the expandable sand screen 210 of the present invention in a wellbore 200 prior to expansion. The ESS includes a base pipe 240 having perforation 242 formed therein, woven filter material 245 and an outer shroud 250 having perforations 255 formed therein and also having outwardly formed longitudinal channels 260 formed thereupon. The channels 260 are formed by bending the surface of the outer shroud 250 between perforations 255 to create two sides 265, 270 and a bottom portion 275. In the preferred embodiment illustrated in FIG. 3, the bottom portion of each channel is welded or otherwise attached to the base pipe in at least one location 280. The woven filter material 245 is held between the bottom 275 of the channel 260 and the base pipe 240. The outer shroud 250 may be formed by any well-known metal working means including pressing and bending. A longitudinal seam (not shown) is formed by the cylindrical shroud after it is wrapped around the base pipe and filter material and its free ends are connected.

Figure 4:
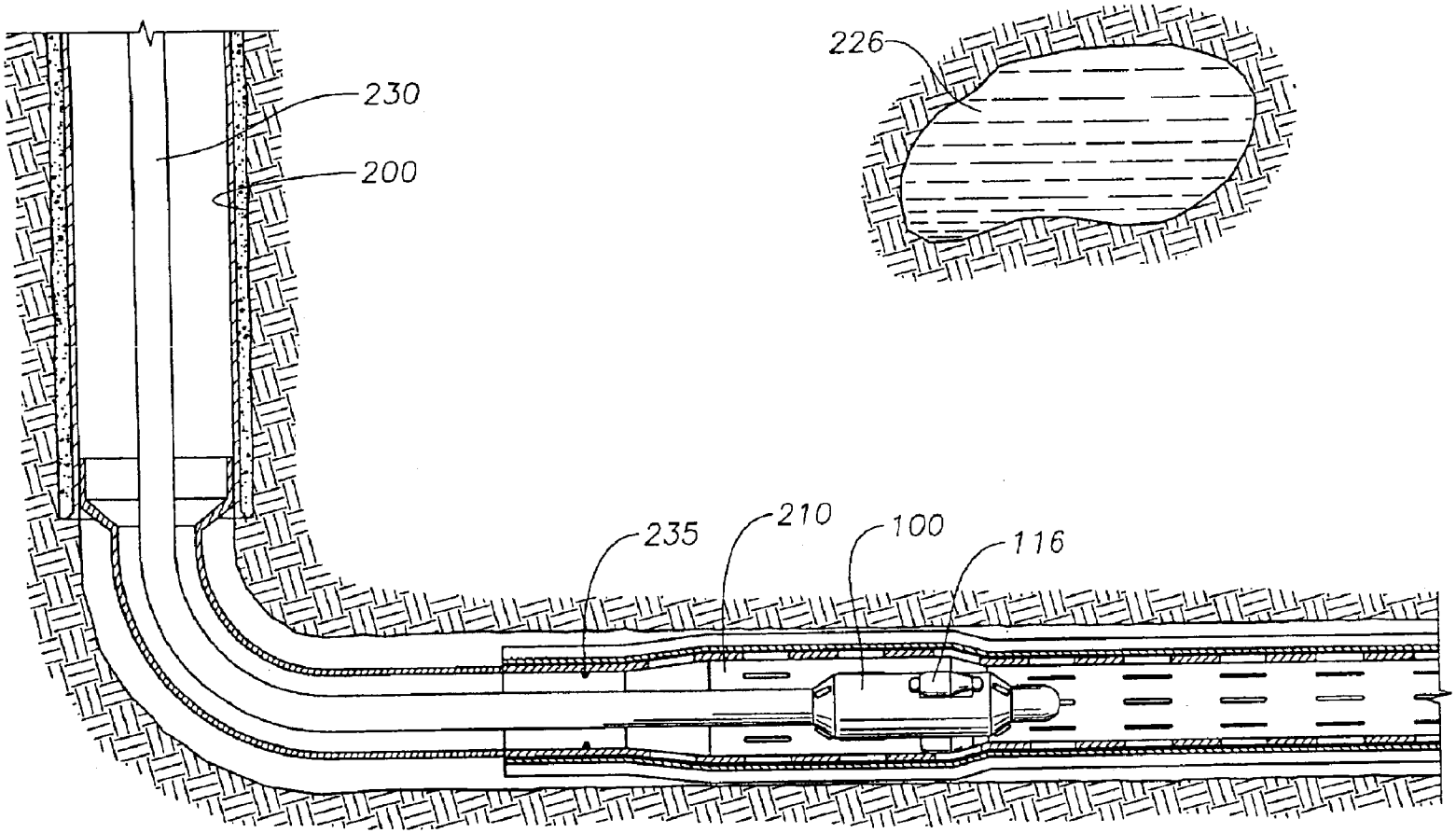
FIG. 4 is a section view of the wellbore with the screen partially expanded.

FIG. 4 is a section view illustrating the wellbore 200 and the ESS 210 partially expanded therein. As shown in the figure, the expansion tool 100 has been activated with its rollers 116 contacting the inner wall of base pipe 240 and applying an outward radial force thereto. Typically, the temporary connection 235 between the expander tool 100 and the ESS 210 is disengaged as the expander tool is actuated and thereafter, the expander tool moves independently of the expandable sand screen 210. By using the run-in string 230 to move the expander tool axially and rotationally within the ESS, the ESS 210 can be circumferentially expanded into or nearly into contact with the wellbore therearound.

Figure 5:
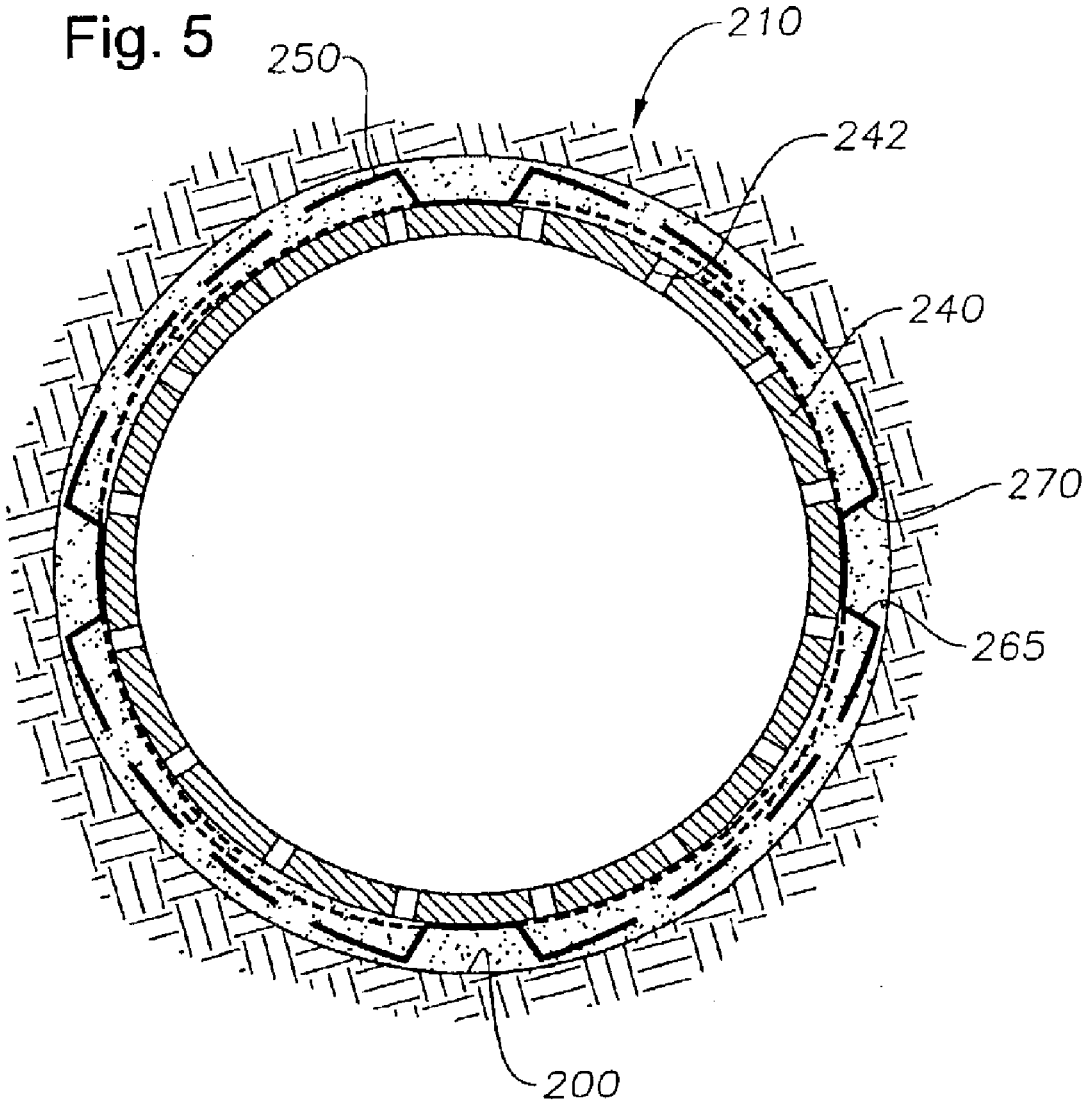
FIG. 5 is a section view of the expandable sand screen in an expanded state.

FIG. 5 is a section view illustrating the expandable sand screen 210 of the present invention after it has been expanded in a wellbore 200. Radial force applied to the inner wall of the base pipe 240 has forced the pipe past its elastic limits and also expanded the diameter of the base pipe perforations 242. Also expanded is the shroud 250 with its formed channels 260. As shown in the figure, the shroud is expanded to a point wherein the upper edges of the sides 265, 270 of the channel 260 are either in contact or almost in contact with the wellbore 200. The decision relating to contact between the expanded sand screen in a wellbore depends upon the needs of the user. Contact between the screen 210 and the wellbore 200 can place a slight stress on the wellbore and reduce the risk of particulate matter entering the wellbore. On the other hand, leaving a slight space between the edges of the channel and the wellbore leaves a greater fluid path for fracturing material to reach areas of the wellbore between the channels.

Figure 6:
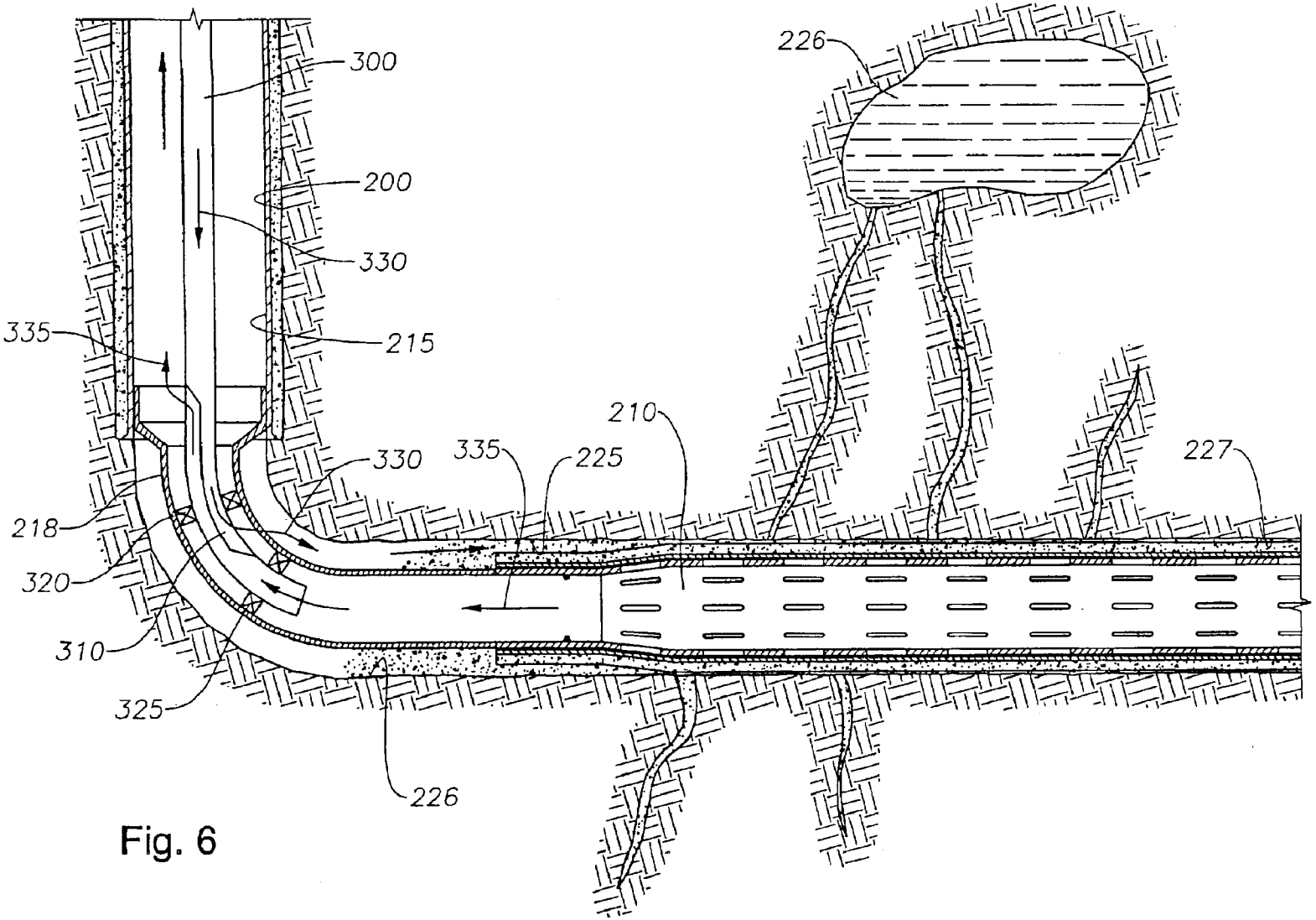
FIG. 6 is a section view of the wellbore being treated with material injected from the surface of the well through a cross-over tool.

FIG. 6 is a section view of the wellbore 200 illustrating an apparatus used to fracture the well after the ESS 210 has been expanded. As illustrated, a string of tubulars 300 is inserted into the top of the liner. An assembly at the lower end of the string of tubulars is typical of one used in fracturing operations and includes a cross-over tool 310 made up of an exit port 315 (not shown) permitting fluids to exit the tubular and a first and second packer 320, 325 disposed on either side of the exiting port to isolate the port from the annular area between the liner and the run-in string. A sliding sleeve (not shown) on the liner permits fluid communication between the interior of the string 300 and the exterior of the liner. As illustrated by arrows 330, a slurry of fracturing and/or packing material is injected from the surface of the well down the tubular string 300. At some predetermined location below the top of the liner 218, the cross-over tool 310 permits the material to flow to an annular area outside of the liner and the expanded sand screen. In this manner, the material flows to the outer surface of the expanded sand screen and longitudinally flows along the channels 260 formed on the exterior of the ESS 210. The particulate material is left within the annular area and within fractures extending outwardly from the wellbore and fluid (illustrated by arrows 335) is returned to the surface of the well in the interior of the string and subsequently, via the annular area between the string 300 and the casing 215 of the central wellbore. In use, a slurry of sand and gel or other fracturing material at an elevated pressure is carried into the central wellbore 200 in a tubular. Using a cross-over tool or other apparatus, the slurry is directed from the tubular to the outer surface of the expanded sand screen where it travels from a heel 226 of the wellbore 225 towards the toe 227 thereof. In this manner, the walls of the wellbore 225 and the formation 226 therearound are exposed to the high pressure slurry via the channels 260 formed on the outer surface of the shroud 250. Return fluid is carried back towards the surface of the well in the interior of the base pipe 240.

One method of utilizing the expandable sand screen of the invention is as follows: A section of expandable sand screen 210 is formed at the surface of a well to an appropriate length by threading joints of screen together. The channels 260 formed in the shroud 250 of each subsequent joint are aligned as the joints are assembled together. The unexpanded section of ESS is then run into the wellbore 200 on a tubular string having an expander tool 100 disposed at the end thereof. The expander tool, or alternatively the run-in string adjacent the tool, is temporarily connected to the expandable sand screen 210 with a temporary connection 235. As the ESS 210 reaches its desired location in the wellbore 200, the expander tool 100 is actuated and the ESS is expanded in at least two points about is circumference. In this manner, the ESS is anchored in the wellbore. By providing a pulling, pushing or rotational movement to the string and expander tool, the temporary connection 235 between the tool 100 and the sand screen 210 is disengaged and the activated expander tool can move independently of the screen 210.

Figure 7:
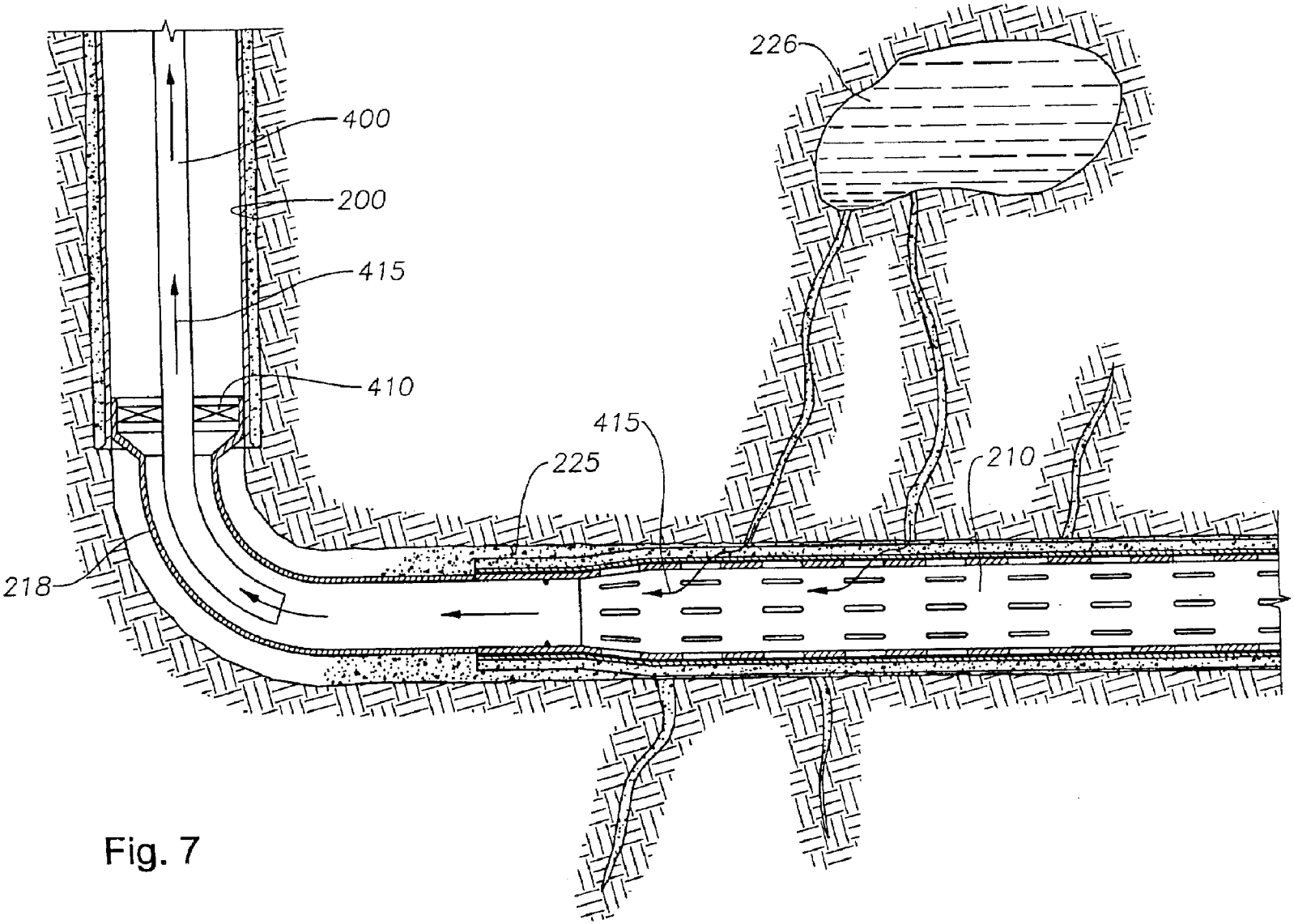
FIG. 7 is a section view of the wellbore tied back to the surface of the wall with a production tubing.

By moving the actuated tool 100 within the sand screen, both rotationally and axially, the screen is expanded to take on an appearance illustrated in FIGS. 5 and 7. With the screen 210 in its expanded position within the wellbore 200, the expansion tool 100 and run-in string are removed and a tubular having a cross-over tool at the end thereof is run into the wellbore. The cross-over tool permits fluid communication between the tubular and the channels 260 on the outer surface of the expanded screen 210. As pressurized slurry travels down the tubular, it is directed by the cross-over tool to the longitudinal channels and is placed in communication with the wellbore.

FIG. 7 is a section view of a central 200 and a lateral 225 wellbore after the ESS 210 has been expanded into position and the well is producing hydrocarbons. A string of tubulars 400 like a string of production tubing has been inserted into the upper portion of the liner 218 and sealed therein with a packer 410. This sealing and arrangement between the liner and the production tubing ties the liner back to the surface of the well. Hydrocarbons illustrated as arrows 415 migrate into the expanded sand screen 210 where they are collected in the interior of the screen and the liner. The hydrocarbons then move directly towards the surface of the well in the conduit provided by production tubing string 400.

While the liner 218 and ESS 210 are shown run into the wellbore on a run in string of tubulars, it will be understood that the apparatus of the invention can be transported into the wellbore using any number of means including coiled tubing. For example, using coiled tubing and a mud motor disposed thereupon, the apparatus can be utilized with rotation provided by the mud motor. A fluid powered tractor can be used to provide axial movement of the apparatus into the lateral wellbore 225. These variations are within the scope of the invention.

As the foregoing demonstrates, the present invention provides an apparatus and methods to utilize expandable sand screen in an open wellbore in a way that minimizes the need to fill an annular area around the screen with gravel. Additionally, the invention provides for an effective fracturing of an open wellbore without the risk of sand bridges being formed between the screen and the walls of the wellbore.

The apparatus described herein is a sand screen intended to filter hydrocarbons. However, the structure described relating to the grooves could be utilized with any expandable wellbore component leaving a fluid path along the outer surface thereof after expansion. Other uses include water wells and injection wells.

While the foregoing is directed to embodiments of the present invention, other and further embodiments of the invention may be devised without departing from the basic scope thereof, and the scope thereof is determined by the claims that follow.

What is claimed is:

1. An expandable screen for use in a wellbore, comprising:

an outer diameter having at least one longitudinal recess therein to provide a fluid path along an outside diameter of the expandable screen, the fluid path substantially isolated from an inside diameter of the expandable screen.

2. The expandable screen of claim 1, wherein the at least one longitudinal recess extends between a first end of the screen to a second end of the screen.

3. The expandable screen of claim 1, wherein there are four longitudinal recesses.

4. The expandable screen of claim 1, wherein the at least one longitudinal recess substantially retains its shape after expansion.

5. The expandable screen of claim 1, wherein the at least one longitudinal recess includes two sides and a bottom surface.

6. The expandable screen of claim 1, wherein the at least one longitudinal recess is disposed alternatively with perforations in the screen.

7. The expandable screen of claim 1, further comprising multiple sections of the expandable screen connected together to form a string with the at least one longitudinal recess of each of the sections aligned in the string.

8. The expandable screen of claim 1, wherein the screen is constructed and arranged to receive an expander tool in an interior thereof, the expander tool having at least one radially extendable rolling member to expand the screen past its elastic limit.

9. The expandable screen of claim 1, wherein the screen comprises:

a perforated base pipe; and an outer shroud disposed around the perforated base pipe.

10. The expandable screen of claim 9, further comprising a porous filter material disposed between the perforated base pipe and the outer shroud.

11. The expandable screen of claim 9, wherein the at least one longitudinal recess is formed on an outer surface of the outer shroud.

12. The expandable screen of claim 11, wherein the at least one longitudinal recess includes two sides and a bottom surface substantially co-planar to the outer surface of the outer shroud.

13. A method of providing fluid communication in an annular area between an expanded screen and a surrounding wellbore, comprising:

circulating fluid through at least one longitudinal recess on an outer diameter of the screen.

14. The method of claim 13, wherein the at least one longitudinal recess extends between a first end of the screen to a second end of the screen.

15. The method of claim 13, wherein portions of the outer diameter of the screen adjacent the at least one longitudinal recess substantially contact the surrounding wellbore.

16. The method of claim 13, wherein the fluid comprises a fracturing material.

17. The method of claim 13, wherein the fluid comprises sand.

18. A method of installing an expandable screen in a wellbore, comprising:

running a section of the expandable screen into the wellbore to a predetermined location;

expanding the screen along at least part of its length to increase the inner and outer diameter thereof; and circulating fluid between the wellbore and the outer diameter of the screen and back through a bore of the screen, wherein the circulating fluid occurs after expanding the screen.

19. The method of claim 18, further comprising causing an outer diameter of the screen having at least one longitudinal recess therein to come substantially into contact with the wellbore, thereby forming a fluid conduit between the at least one longitudinal recess and the wellbore.

20. The method of claim 18, wherein the fluid comprises a fracturing material.

21. The method of claim 18, wherein the fluid comprises sand.

22. A method of installing an expandable screen in a wellbore, comprising:

running a section of the expandable screen into the wellbore;

expanding the screen along at least part of its length; and circulating fluid through a longitudinal recess on the outer diameter of the screen.

23. The method of claim 22, wherein the fluid comprises a fracturing material.

24. The method of claim 22, wherein the fluid comprises sand.

25. A method of flowing a material between an expandable screen and a wellbore wall, comprising:

inserting the expandable screen into the wellbore, the screen having at least one channel formed longitudinally along the outer surface thereof, the at least one channel providing a fluid path substantially isolated from an interior of the expandable screen;

expanding the walls of the screen in the direction of the wellbore; and flowing the material along the at least one channel.

26. An expandable tubular for use in a wellbore, comprising:

an outer diameter having at least one longitudinal recess therein to provide a fluid path along an outside diameter of the expandable tubular, the fluid path substantially isolated from an inside diameter of the expandable tubular.

27. A method of installing an expandable tubular in a wellbore, comprising:

running a section of the expandable tubular into the wellbore;

expanding the tubular along at least part of its length; and circulating fluid through a fluid path along an outside diameter of the expandable tubular, wherein the fluid path is defined by a longitudinal recess on the outside diameter of the expandable tubular.

28. The method of claim 27, wherein the fluid is in communication with the walls of the wellbore surrounding the tubular.

* * * * *